US008729005B2

(12) United States Patent
McKechnie et al.

(10) Patent No.: US 8,729,005 B2
(45) Date of Patent: May 20, 2014

(54) HARD SURFACE CLEANING COMPOSITIONS

(75) Inventors: Malcolm Tom McKechnie, Hull (GB); Edward Staunton, East Yorkshire (GB); Alfred Vincent Spencer, Westwood, NJ (US); Neil Atkin, Hull (GB); Wesley Bowyer, North East Lincolnshire (GB)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 64 days.

(21) Appl. No.: 13/062,264

(22) PCT Filed: Aug. 5, 2009

(86) PCT No.: PCT/GB2009/001915

§ 371 (c)(1),
(2), (4) Date: Mar. 4, 2011

(87) PCT Pub. No.: WO2010/029279

PCT Pub. Date: Mar. 18, 2010

(65) Prior Publication Data

US 2011/0160116 A1 Jun. 30, 2011

(30) Foreign Application Priority Data

Sep. 9, 2008 (GB) ..... 0816440.2

(51) Int. Cl.

| | |
|---|---|
| ***C11D 1/72*** | (2006.01) |
| ***C11D 3/20*** | (2006.01) |
| ***C11D 3/37*** | (2006.01) |
| ***C11D 3/43*** | (2006.01) |

(52) U.S. Cl.
USPC ..... 510/238; 510/421; 510/422; 510/434; 510/438; 510/475; 510/477; 510/488; 510/504; 510/505; 510/506

(58) Field of Classification Search
USPC ..... 510/238, 421, 422, 434, 438, 475, 477, 510/488, 504, 505, 506; 134/39, 40
See application file for complete search history.

(56) References Cited

U.S. PATENT DOCUMENTS

| | | | | |
|---|---|---|---|---|
| 2,974,134 | A | 3/1961 | Pollitzer | |
| 3,219,656 | A | 11/1965 | Boettner | |
| 3,598,865 | A | 8/1971 | Lew | |
| 3,640,998 | A | 2/1972 | Mansfield et al. | |
| 3,707,535 | A | 12/1972 | Lew | |
| 3,772,269 | A | 11/1973 | Lew | |
| 3,839,318 | A | 10/1974 | Mansfield | |
| 3,974,138 | A | 8/1976 | Lew | |
| 4,223,129 | A | 9/1980 | Roth et al. | |
| 4,528,106 | A | 7/1985 | Grolitzer | |
| 5,783,537 | A * | 7/1998 | Ahmed et al. | 510/193 |
| 5,863,876 | A | 1/1999 | Lance-Gomez et al. | |
| 5,990,066 | A * | 11/1999 | Gordon et al. | 510/238 |
| 6,214,627 | B1 | 4/2001 | Ciota et al. | |
| 6,376,449 | B2 * | 4/2002 | Olsen | 510/392 |
| 6,482,793 | B1 * | 11/2002 | Gordon et al. | 510/475 |
| 6,551,985 | B1 * | 4/2003 | Bianchetti et al. | 510/475 |

FOREIGN PATENT DOCUMENTS

| | | | |
|---|---|---|---|
| GB | 1076979 | A | 7/1967 |
| GB | 1257812 | A | 12/1971 |
| GB | 2392167 | A | 2/2004 |
| GB | 2429016 | A | 2/2007 |
| WO | 98 01525 | | 1/1998 |
| WO | WO2008/015381 | * | 2/2008 |
| WO | 2008 068488 | | 6/2008 |

OTHER PUBLICATIONS

WPI Abstract Accession No. 1998-217240, (Mar. 1998).
The UK Search Report, (Dec. 2008).
International Search Report, (Dec. 2009).

* cited by examiner

*Primary Examiner* — Gregory R Delcotto
(74) *Attorney, Agent, or Firm* — Norris McLaughlin & Marcus PA

(57) ABSTRACT

An aqueous liquid acidic hard surface cleaning composition having a pH of about 2-4 which necessarily comprises: an acid constituent, which is preferably an organic acid constituent, and especially preferably acetic acid, at least one non-ionic surfactant, and especially preferably wherein the non-ionic surfactants are derived from Guerbet alcohols; an organic solvent constituent which comprises at least one glycol ether solvent, preferably a glycol ether solvent; a sequestering polymer constituent; optionally a cosurfactant constituent, including one or more anionic, cationic, amphoteric or zwitterionic surfactants; optionally one or more further constituents selected coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents known to the art; and the balance, water, wherein water comprises at least 80% wt. of the composition.

8 Claims, No Drawings

HARD SURFACE CLEANING COMPOSITIONS

This is an application filed under 35 USC 371 of PCT/GB2009/001915.

The present invention relates to aqueous acidic hard surface cleaning compositions.

Hard surface cleaning compositions are commercially important products and enjoy a wide field of use, and are known in assisting in the removal of dirt and grime from surfaces, especially those characterized as useful for cleaning "hard surfaces". Hard surfaces include those which are frequently encountered in lavatories, for example lavatory fixtures such as toilets, shower stalls, bathtubs, bidets, sinks, etc., as well as countertops, walls, floors, etc. In such lavatory environments two types of commonly encountered stains in lavatories include "hard water" stains, "soap scum" stains as well as "rust stains". Such hard surfaces, and such stains, may also be found in different environments as well, including kitchens, hospitals, etc. Hard water stains are mineral stains caused by the deposition of salts, such as calcium or magnesium salts which are frequently present in hard water which is commonly encountered. Soap scum stains are residues of fatty acid soaps, such as soaps which are based on alkaline salts of low fatty acids. These fatty acids are known to precipitate in hard water due to the presence of metal salts therein leaving an undesirable residue upon such surfaces. Still further stains, typically referred to as greasy stains, are surface residues which generally comprise hydrophobic materials often with further materials which leave unsightly residues on surfaces. Rust stains are typically formed by the presence of undesired amounts of iron oxides in water which may form unsightly deposits on hard surfaces.

While the prior art provides a variety of compositions which provide effective cleaning of one or more, typically all of the foregoing classes of stains, there is still an urgent need in the art to provide improved hard surface cleaning compositions which are effective in the treatment of many types of stains typically encountered on hard surfaces, particularly in a home or commercial environment, especially in or around kitchens, bathrooms where cleanliness is of special importance. It is to such needs that the compositions of the present invention are particularly directed.

Broadly, the present invention relates to liquid acidic hard surface cleaning compositions which are effective against common stains encountered on hard surfaces, methods for their use in the cleaning of soap scum and limescale deposits from hard surfaces, as well as methods for their manufacture.

In one specific aspect there is provided a highly aqueous liquid acidic hard surface cleaning composition having a pH of about 2-4 which necessarily comprises:

an acid constituent, which is preferably an organic acid constituent, and especially preferably acetic acid, at least one nonionic surfactant, and especially preferably wherein the nonionic surfactants are derived from Guerbet alcohols;

a sequestering polymer constituent;

optionally but especially preferably, an organic solvent constituent which comprises at least one glycol ether solvent, preferably a glycol ether solvent;

optionally a cosurfactant constituent, including one or more anionic, cationic, amphoteric or zwitterionic surfactants;

optionally one or more further constituents selected coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents known to the art;

and the balance, water, wherein water comprises at least 80% wt. of the composition.

In certain preferred embodiments the nonionic surfactant based on Guerbet alcohols is the sole surfactant constituent present in the compositions, to the exclusion of further nonionic, cationic, amphoteric or zwitterionic surfactants.

In a still further preferred embodiment, the nonionic surfactant based on Guerbet alcohols is present with one or more nonionic cosurfactants optionally with one or more further nonionic co-surfactants, and further preferably to the exclusion of further non-nonionic surfactants particularly cationic, amphoteric or zwitterionic surfactants.

In further preferred embodiments there are provided carrier substrates, e.g., wipes, sponges, and the like comprising a highly aqueous liquid acidic hard surface cleaning composition as described herein.

The present invention also provides for methods for the manufacture of the aforesaid aqueous acidic hard surface cleaning compositions, either in liquid form as well as in the form of carrier substrates impregnated with the aqueous acidic hard surface cleaning compositions.

The present invention also provides for methods for the treatment of stained hard surfaces in need of cleaning, especially cleaning of soap scum and/or limescale stains or deposits on such hard surfaces, which method comprises the step of applying a cleaning effective amount of the acidic hard surface cleaning composition as described herein to a hard surface in need of a cleaning treatment.

The present invention also provides for compositions which exhibit good cleaning properties against dirt and stains commonly found in household, commercial and residential settings, particularly in lavatory settings wherein limescale and soap scum stains are frequently encountered.

The compositions of the invention necessarily include an organic acid constituent. Exemplary organic acids are those which generally include at least one carbon atom, and include at least one carboxyl group (—COOH) in its structure. Exemplary useful water soluble organic acids which contain from 1 to about 6 carbon atoms, and at least one carboxyl group as noted. Exemplary useful organic acids include: linear aliphatic acids such as acetic acid, citric acid, propionic acid, butyric acid and valeric acid; dicarboxylic acids such as malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, α-hydroxybutyric acid, glyceric acid, tartronic acid, malic acid, tartaric acid and citric acid, as well as acid salts of these organic acids. The use of water soluble acids are preferred, including water soluble salts of organic acids. Particularly preferred are compounds having one to four carbon atoms and which include only carboxyl group such ethanoic acid, commonly referred to as acetic acid. The organic acid constituent may be included in any amount in order to establish a pH of from about 2 to about 4 for the compositions. Advantageously the organic acid constituent forms 0.1-7% wt., preferably 2-5% wt. of the composition of which it forms a part, and preferably the organic acid constituent comprises acetic acid, and optionally one or more further organic acids, but especially preferably wherein the organic acid constituent solely consists of acetic acid.

The inventors have surprisingly found that the inclusion of acetic acid in the inventive compositions, particularly wherein acetic acid is the sole organic acid present in the compositions has an unexpectedly beneficial effect on the cleaning performance of limescale and soap scum stains from hard surfaces, notwithstanding the relatively moderate pH of the compositions, viz. pH of about 2 to about 4.

The compositions of the invention further necessarily include at least one nonionic surfactant, and especially preferably wherein the nonionic surfactants are derived from Guerbet alcohols.

One class of exemplary useful nonionic surfactants are polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

Further useful nonionic surfactants include the condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5 (also available as Teric G9A5), which is described in product literature from Sasol as a $C_{8-10}$ having an average molecular weight of 356, an ethylene oxide content of about 4.85 moles (about 60 wt. %), and an HLB of about 12; Alfonic® 810-2, which is described in product literature from Sasol as a $C_{8-10}$ having an average molecular weight of 242, an ethylene oxide content of about 2.1 moles (about 40 wt. %), and an HLB of about 12; and Alfonic® 610-3.5, which is described in product literature from Sasol as having an average molecular weight of 276, an ethylene oxide content of about 3.1 moles (about 50 wt. %), and an HLB of 10. Product literature from Sasol also identifies that the numbers in the alcohol ethoxylate name designate the carbon chain length (numbers before the hyphen) and the average moles of ethylene oxide (numbers after the hyphen) in the product.

Further exemplary useful nonionic surfactants include ethoxylated available from Shell Chemical Company which are described as $C_9$-$C_{11}$ ethoxylated alcohols and marketed under the Neodol® tradename. The Neodol® 91 series nonionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series nonionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630.

Further examples of ethoxylated alcohols include those from Tomah Products (Milton, Wis.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear C9/C10/C11 and n is 2.5, 6, or 8; 1-3; 1-5; 1-7; 1-73B; 1-9;—where R is linear C11 and n is 3, 5, 7 or 9; 23-1; 23-3; 23-5; 23-6.5—where R is linear C12/C13 and n is 1, 3, 5, or 6.5; 25-3; 25-7; 25-9; 25-12—where R is linear C12/C13 C14/C15 and n is 3, 7, 9, or 12; and 45-7; 45-13—where R is linear C14/C15 and n is 7 or 13.

Other examples of useful nonionic surfactants include those having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename. available from Clariant, Charlotte, N.C., include the 26-L series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N. From product literature, the single number following the "L" corresponds to the average degree of ethoxylation (numbers between 1 and 5) and the two digit number following the letter "L" corresponds to the cloud point in ° C. of a 1.0 wt. % solution in water.

A further class of nonionic surfactants which are contemplated to be useful include those based on alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z\text{—}H \quad (A)$$

where EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC tradename from BASF or Emulgen from Kao.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO—(BO)_n(EO)_x—H \quad (C)$$

wherein R is an alkyl group containing I to 20 carbon atoms, n is about 5-15 and x is about 5-15.

Also useful as the nonionic block copolymer surfactants, which also include polymeric butoxy groups, are those which may be represented by the following formula (D):

$$HO\text{-}(EO)_x(BO)_n(EO)_y—H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

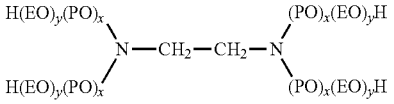

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Surfactants based on amine oxides are also contemplated to be useful in the cosurfactant constituent in the present inventive compositions. Exemplary amine oxides include:

alkyl di($C_1$-$C_7$) amine oxides in which the alkyl group has about 10-20, and preferably 12-16 carbon atoms, and can be straight or branched chain, saturated or unsaturated. Examples of such compounds include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

alkyl di(hydroxy $C_1$-$C_7$) amine oxides in which the alkyl group has about 10-20, and preferably 12-16 carbon atoms, and can be straight or branched chain, saturated or unsaturated. Examples of such compounds include bis(2-hydroxyethyl) cocoamine oxide, bis(2-hydroxyethyl) tallowamine oxide; and bis(2-hydroxyethyl) stearylamine oxide;

alkylamidopropyl di($C_1$-$C_7$) amine oxides in which the alkyl group has about 10-20, and preferably 12-16 carbon atoms, and can be straight or branched chain, saturated or unsaturated. Examples of such compounds include cocoamidopropyl dimethyl amine oxide and tallowamidopropyl dimethyl amine oxide; and alkylmorpholine oxides in which the alkyl group has about 10-20, and preferably 12-16 carbon atoms, and can be straight or branched chain, saturated or unsaturated.

Preferably the amine oxide constituent is an alkyl di(lower alkyl) amine oxide as denoted above and which may be represented by the following structure:

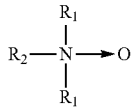

wherein each:

$R_1$ is a straight chained $C_1$-$C_4$ alkyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{12}$ alkyl group. Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{12}$ alkyl groups and at least 25% wt. of $C_{14}$ alkyl groups, with not more than 15% wt. of $C_{16}$, $C_{18}$ or higher alkyl groups as the $R_2$ group.

Exemplary useful amine oxides may be obtained from a variety of commercial sources and include for example amine oxides available in the AO series from Tomah Products Inc.; in the AMMONYX series from Stepan Co.; in the BARLOX series from Lonza Inc. (Fairlawn, N.J.), in the RHODAMOX series from Rhone-Poulenc Inc. (Cranbury, N.J.), as well as in the MACKAMINE series of products from McIntyre Group Ltd.

Alkylpolyglucosides may also be present in the inventive compositions and such are to be understood as including alkylmonoglucosides and alkylpolyglucosides surfactant based on a polysaccharide, which are preferably one or more alkyl polyglucosides. These materials may also be referred to as alkyl monoglucosides and alkylpolyglucosides. Suitable alkyl polyglucosides are known nonionic surfactants which are alkaline and electrolyte stable. Such include alkyl glucosides, alkyl polyglucosides and mixtures thereof. Alkyl glucosides and alkyl polyglucosides can be broadly defined as condensation articles of long chain alcohols, e.g., $C_8$-$C_{30}$ alcohols, with sugars or starches or sugar or starch polymers i.e., glucosides or polyglucosides. These compounds can be represented by the formula $(S)_n$—O—R wherein S is a sugar moiety such as glucose, fructose, mannose, and galactose; n is an integer of from about 1 to about 1000, and R is a $C_{8-30}$ alkyl group. Examples of long chain alcohols from which the alkyl group can be derived include decyl alcohol, cetyl alcohol, stearyl alcohol, lauryl alcohol, myristyl alcohol, oleyl alcohol and the like.

Alkyl mono- and polyglucosides are prepared generally by reacting a monosaccharide, or a compound hydrolyzable to a monosaccharide with an alcohol such as a fatty alcohol in an acid medium. Various glucoside and polyglucoside compounds including alkoxylated glucosides and processes for making them are disclosed in U.S. Pat. Nos. 2,974,134; 3,219,656; 3,598,865; 3,640,998; 3,707,535; 3,772,269; 3,839,318; 3,974,138; 4,223,129; and 4,528,106.

Exemplary useful alkyl glucoside surfactants suitable for use in the practice of this invention may be represented by formula I below:

$$RO—(R_1O)_y-(G)_xZ_b \quad \text{I}$$

wherein:

R is a monovalent organic radical containing from about 6 to about 30, preferably from about 8 to about 18 carbon atoms;

$R_1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$,

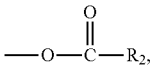

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a

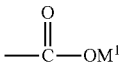

group);

b is a number of from 0 to 3x+1 preferably an average of from 0.5 to 2 per glycosal group;

p is 1 to 10, $M^1$ is $H^+$ or an organic or inorganic cation, such as, for example, an alkali metal, ammonium, monoethanolamine, or calcium.

As defined in Formula I above, R is generally the residue of a fatty alcohol having from about 8 to 30 and preferably 8 to 18 carbon atoms.

Further exemplary useful alkylpolyglucosides include those according to the formula II:

$$R_2O—(C_nH_{2n}O)_r—(Z)_x \quad \text{II}$$

wherein:

$R_2$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3; r is an integer from 0 to 10, but is preferably 0, Z is derived from glucose; and, x is a value from about 1 to 8, preferably from about 1.5 to 5.

Preferably the alkylpolyglucosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

Examples of such alkylpolyglucosides as described above include, for example, APG™ 325 which is described as being a $C_9$-$C_{11}$ alkyl polyglucoside, also commonly referred to as D-glucopyranoside, (ex. Cognis). Further exemplary alkylpolyglucosides include Glucopon® 625 CS which is described as being a $C_{10}$-$C_{16}$ alkyl polyglucoside, also commonly referred to as a D-glucopyranoside, (ex. Cognis), lauryl polyglucoside available as APG™ 600 CS and 625 CS (ex. Cognis) as well as other materials sold under the Glucopon® tradename, e.g., Glucopon® 215, Glucopon® 225, Glucopon® 425, especially one or more of the alkyl polyglucosides demonstrated in one or more of the examples. It is believed that the alkylpolyglucoside surfactants sold under the Glucopon® tradename are synthezied at least in part on synthetically produced starting constituents and are colorless or only slightly colored, while those sold under the APG™ are synthesized at least in part on naturally occurring or sourced starting constituents and are more colored in appearance.

Especially preferred for use in the nonionic surfactant constituent are one or more nonionic surfactants derived from Guerbet alcohols, and particularly preferably wherein the sole nonionic surfactants present are derived from Guerbet alcohols.

Exemplary and preferred nonionic surfactants based on Guerbet alcohols include those are presently commercially available under the Lutensol® (ex. BASF AG) and are available in a variety of grades e.g., Lutensol® XL 40 recited by its supplier to be a C10-Guerbet alcohol which is approximately 4 moles of ethoxylation, Lutensol® XL 50 recited by its supplier to be a C10-Guerbet alcohol which is approximately 5 moles of ethoxylation, Lutensol® XL 60 recited by its supplier to be a C10-Guerbet alcohol which is approximately 6 moles of ethoxylation, Lutensol® XL 70 recited by its supplier to be a C10-Guerbet alcohol which is approximately 7 moles of ethoxylation, Lutensol® XL 40 recited by its supplier to be a C10-Guerbet alcohol which is approximately 4 moles of ethoxylation, Lutensol® XL 79 recited by its supplier to be a C10-Guerbet alcohol which is approximately 7 moles of ethoxylation, Lutensol® XL 80 recited by its supplier to be a C10-Guerbet alcohol which is approximately 8 moles of ethoxylation, Lutensol® XL 89 recited by its supplier to be a C10-Guerbet alcohol which is approximately 8 moles of ethoxylation, Lutensol® XL 90 recited by its supplier to be a C10-Guerbet alcohol which is approximately 9 moles of ethoxylation, Lutensol® XL 99 recited by its supplier to be a C10-Guerbet alcohol which is approximately 9 moles of ethoxylation, Lutensol® XL 100 recited by its supplier to be a C10-Guerbet alcohol which is approximately 10 moles of ethoxylation, Lutensol® XL 140 recited by its supplier to be a C10-Guerbet alcohol which is approximately 14 moles of ethoxylation, all available from BASF AG. Alternately or additionally, nonionic surfactant based on monobranched alkoxylated C10-fatty alcohols marketed under the Lutensol® XP series of surfactants, also ex. BASF AG, may also be used. By way of non-limiting example such include: Lutensol® XP 30 recited by its supplier to be a C10-Guerbet alcohol which is approximately 3 moles of ethoxylation; Lutensol® XP 40 recited by its supplier to be a C10-Guerbet alcohol which is approximately 4 moles of ethoxylation; Lutensol® XP 50 recited by its supplier to be a C10-Guerbet alcohol which is approximately 5 moles of ethoxylation; Lutensol® XP 60 recited by its supplier to be a C10-Guerbet alcohol which is approximately 6 moles of ethoxylation; Lutensol® XP 70 recited by its supplier to be a C10-Guerbet alcohol which is approximately 7 moles of ethoxylation; Lutensol® XP 79 recited by its supplier to be a C10-Guerbet alcohol which is approximately 7 moles of ethoxylation; Lutensol® XP 80 recited by its supplier to be a C10-Guerbet alcohol which is approximately 8 moles of ethoxylation; Lutensol® XP 89 recited by its supplier to be a C10-Guerbet alcohol which is approximately 8 moles of ethoxylation; Lutensol® XP 90 recited by its supplier to be a C10-Guerbet alcohol which is approximately 9 moles of ethoxylation; Lutensol® XP 99 recited by its supplier to be a C10-Guerbet alcohol which is approximately 9 moles of ethoxylation; Lutensol® XP 100 recited by its supplier to be a C10-Guerbet alcohol which is approximately 10 moles of ethoxylation; and Lutensol® XP 140 recited by its supplier to be a C10-Guerbet alcohol which is approximately 14 moles of ethoxylation.

While the foregoing materials are ethoxylated, it is to be understood that other alkoxylated, e.g., propoxylated, butoxylated, as well as mixed ethoxylated and propoxylated branched nonionic alkyl polyethylene glycol ether may also be used.

Further exemplary and preferred nonionic surfactants based on Guerbet alcohols include alkylpolyglucosides based on Guerbet alcohols. Nonlimiting examples include those currently marketed under the AG 6202, AG 6206 and AG 6210 designations by AkzoNobel.

The nonionic surfactant constituent comprises 0.5-5% wt., preferably 2-5% wt. of the inventive compositions wherein said constituent comprises at least one nonionic surfactant, and especially preferably wherein the nonionic surfactants are derived from Guerbet alcohols, and particularly preferably wherein the sole nonionic surfactants present are derived from Guerbet alcohols. Particularly preferred sole nonionic surfactants present are derived from Guerbet alcohols are described with reference to one or more of the examples.

The compositions of the invention may optionally include a cosurfactant constituent, including one or more anionic, cationic, amphoteric or zwitterionic surfactants.

Exemplary of anionic surfactants which may be present include alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof. These anionic surfactants may be provided as salts with one or more organic counterions, e.g, ammonium, or inorganic counteraions, especially as salts of one or more alkaline earth or alkaline earth metals, e.g, sodium.

Further examples of anionic surfactants include water soluble salts or acids of the formula $(ROSO_3)_xM$ or $(RSO_3)_xM$ wherein R is preferably a $C_6$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a mono-, di- or tri-valent cation, e. g., an alkali metal cation (e. g., sodium, potassium, lithium), or ammonium or substituted ammonium (e. g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like) and x is an integer, preferably 1 to 3, most preferably 1. Materials sold under the Hostapur and Biosoft trademarks are examples of such anionic surfactants.

Still further examples of anionic surfactants include alkyl-diphenyl-ethersulphonates and alkyl-carboxylates.

Also useful as anionic surfactants are diphenyl disulfonates, and salt forms thereof, such as a sodium salt of diphenyl disulfonate commercially available as Dowfax® 3B2. Such diphenyl disulfonates are included in certain preferred embodiments of the invention in that they provide not only a useful cleaning benefit but concurrently also provide a useful degree of hydrotropic functionality.

Other anionic surfactants can include salts (including, for example, sodium, potassium, ammonium, and substituted ammonium salts such as mono-, di-and triethanolamine salts) of soap, $C_6$-$C_{20}$ linear alkylbenzenesulfonates, $C_6$-$C_{22}$ primary or secondary alkanesulfonates, $C_6$-$C_{24}$ olefinsulfonates, sulfonated polycarboxylic acids prepared by sulfonation of the pyrolyzed product of alkaline earth metal citrates, $C_6$-$C_{24}$ alkylpolyglycolethersulfates, alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Examples of the foregoing anionic surfactants are available under the following tradenames: Rhodapon®, Stepanol®, Hostapur®, Surfine®, Sandopan®, Neodox®, Biosoft®, and Avanel®.

An anionic surfactant compound which may be particularly useful in the inventive compositions when the compositions are at a pH of 2 or less are one or more anionic surfactants based on alphasulphoesters including one or more salts thereof. Such particularly preferred anionic surfactants may be represented by the following general structures:

(A)

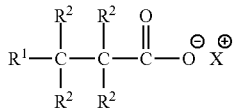

(B)

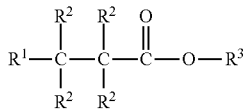

wherein, in each of the foregoing:

$R^1$ represents a $C_6$-$C_{22}$ alkyl or alkenyl group;

each of $R^2$ is either hydrogen, or if not hydrogen is a $SO_3^-$ having associated with it a cation, $X^+$, which renders the compound water soluble or water dispersible, with X preferably being an alkali metal or alkaline earth metal especially sodium or potassium, especially sodium, with the proviso that at least one $R^2$, preferably at least two $R^2$ is a $(SO_3^-)$ having an associated cation $X^+$, and, $R^3$ represents a $C_1$-$C_6$, preferably $C_1$-$C_4$ lower alkyl or alkenyl group, especially methyl.

According to certain preferred embodiments, anionic surfactants are however expressly excluded from the compositions of the present invention.

Exemplary and preferred cationic surfactants which may be used in the inventive compositions are those which provide a broad antibacterial or sanitizing function. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Functional Materials,* Vol. 2, 1998; Kirk-Othmer, *Encyclopedia of Chemical Technology,* 4th Ed., Vol. 23, pp. 481-541 (1997), the contents of which are herein incorporated by reference. These are also described in the respective product specifications and literature available from the suppliers of these cationic surfactants.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

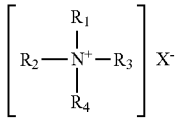

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

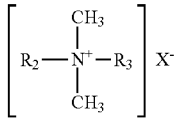

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, *McCutcheon's Functional Materials* (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in McCutcheon's as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC ® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% acive); BTC® 776 is described to be myrisalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

According to certain preferred embodiments, cationic surfactants are however expressly excluded from the compositions of the present invention.

By way of non-limiting example exemplary amphoteric or zwitterionic surfactants which are contemplated to be useful in the cosurfactant constituent include one or more water-soluble betaine surfactants which may be represented by the general formula:

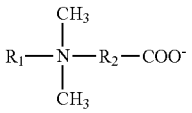

wherein $R_1$ is an alkyl group containing from 8 to 18 carbon atoms, or the amido radical which may be represented by the following general formula:

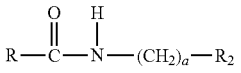

wherein R is an alkyl group having from 8 to 18 carbon atoms, a is an integer having a value of from 1 to 4 inclusive, and $R_2$ is a $C_1$-$C_4$ alkylene group. Examples of such water-soluble betaine surfactants include dodecyl dimethyl betaine, as well as cocoamidopropylbetaine.

According to certain preferred embodiments, amphoteric and/or zwitterionic surfactants are however expressly excluded from the compositions of the present invention.

When present, the total amount of such one or more optional cosurfactants present in the inventive compositions do not exceed about 10% wt., preferably do not exceed 7.5% wt., and most preferably do not exceed 5% wt., based on the total weight of the compositions of which they form a part. As noted above, in certain preferred embodiments one or more of the optional cosurfactants are expressly excluded from the compositions of the invention.

The inventive compositions necessarily includes an organic solvent constituent which comprises at least one glycol ether solvent. Useful glycol ethers are those having the general structure $R_a$—O—$R_b$—OH, wherein $R_a$ is an alkyl of 1 to 20 carbon atoms, or an aryl of at least 6 carbon atoms, and $R_b$ is an alkylene of 1 to 8 carbons or is an ether or polyether containing from 2 to 20 carbon atoms. Exemplarly glycol ethers include those selected from the group consisting of ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate and mixtures thereof. Of the foregoing, propylene glycol n-propyl ether is particularly preferred.

In addition to the glycol ether which is necessarily included in the organic solvent constituent, said constituent may include one or more further organic solvents as co-solvents which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), lower esters of monoalkylethers of ethylene glycol or propylene glycol (e.g. propylene glycol monomethyl ether acetate), and mixtures thereof. Mixtures of two or more specific organic solvents may be used, or alternately a single organic solvent may be provided as part of the organic solvent constituent.

When present, such optional organic co-solvent(s) may be present in amounts of up to about 10% wt, preferably are present in amounts of from about 1-99%., still more preferably from about 5-95% of the weight of the organic solvent constituent present in the inventive compositions. As stated previously however, in certain particularly preferred embodiments, the organic co-solvents are excluded from the inventive compositions, and the organic solvent constituent consists solely of one or more glycol ethers, and especially preferably includes, or consists of propylene glycol n-propyl ether, e.g, commercially available as Dowanol PnP (ex. DOW Chem. Co.) The organic solvent constituent of the invention which comprises at least one glycol ether solvent, comprises 0.1-7% wt., preferably 0.5-5% wt., of the hard surface treatment composition of which it forms a part.

A further essential constituent of the invention is a sequestering polymer constituent. Exemplary sequestering polymer constituents include polycarboxylic acid polymers, preferably polyacrylic polymers, based on acrylic acid combined with or without other moieties. These include acrylic acid combined with; maleic acid (such as Sokalan CP5 and CP7 supplied by BASF or Acusol 479N supplied by Rohm & Haas); methacrylic acid (such as Colloid 226/35 supplied by Rhone-Poulenc); phosphonate (such as Casi 773 supplied by Buckman Laboratories); maleic acid and vinyl acetate (such as polymers supplied by Huls); acrylamide; sulfophenol methallyl ether (such as Aquatreat AR 540 supplied by Alco); 2-acrylamido-2-methylpropane sulfonic acid (such as Acumer 3100 supplied by Rohm & Haas or such as K-775 supplied by Goodrich); 2-acrylamido-2-methylpropane sulfonic acid and sodium styrene sulfonate (such as K-798 supplied by Goodrich); methyl methacrylate; sodium methallyl sulfonate and sulfophenol methallyl ether (such as Alcoperse 240 supplied by Alco); polymaleates (such as Belclene 200 supplied by FMC); polymethacrylates (such as Tamol 850 from Rohm & Haas); polyaspartates or ethylenediamine disuccinate and organo polyphosphonic acids and their salts such as the sodium salts of aminotri(methylenephosphonic acid) and ethane 1-hydroxy-1,1-diphosphonic acid. In certain preferred embodiments, the sequestering polymer is a homopolymer of acrylic acid, blended with or without a polymaleic acid polymer or a polyacrylic/polymaleic acid copolymer. Preferably the sequestering polymer is a homopolymer of acrylic acid (such as those sold by Rohm & Haas under the Acusol® trademark, such as Acusol WE).

Further examples of useful and in some cases, preferred, sequestering polymers include polysufonated polymers including but not limited to, polystyrene sulfonic acid polymers and polyvinyl sulfonic acid polymers. Such may be polyacrylic acid homopolymer, copolymers of acrylic acid and acrylamide and post-polymerization derivatized terpolymers of acrylamide/acrylic acid and either acrylamido ethane sulfonic acid or acrylamido methane sulfonic acid. These preferred polymers include, but are not limited to, a terpolymer of acrylic acid (about 60 to 70 mole %), acrylamide (about 9 to 27 mole %) and acrylamidomethanesulfonic acid, sodium salt (about 13 to 21 mole %) with a weight average molecular weight of between about 8,000 and about 45,000 Daltons; a terpolymer of acrylic acid (about 40 to 50 mole %), acrylamide (about 15 to 35 mole %) and acrylamidomethanesulfonic acid, sodium salt (about 25 to 35 mole %), said terpolymer having a weight average molecular weight of between about 10,000 and 55,000 Daltons; a polyacrylic acid, sodium salt homopolymer, with a weight average molecular weight of between about 500 and about 10,000 Daltons; a copolymer of acrylic acid (about 90 mole %) and styrenesulfonic acid, sodium salt (about 10 mole %) with a weight average molecular weight of between about 10,000 and about 75,000 Daltons; and a copolymer of acrylic acid (about 99 mole %) and styrenesulfonic acid, sodium salt (about 1 mole %) with a weight average molecular weight of between about 3000 and about 15,000 Daltons. Exemplary copolymers of acrylic acid and acrylamide useful as sequestering polymers are available from Nalco Chemical Company under the Transport Plus® trademark. Examplary terpolymers of acrylamide/acrylic acid and acrylamido methane sulfonic acid useful as sequestering polymers are available from Nalco Chemical company under the Prism® trademark. Further examples of useful sequestering polymers in include those described in U.S. Pat. No. 6,214,627 the contents of which are herein incorporated by reference. Further useful sequestering polymers are believed to be known to persons of ordinary skill in the art.

In certain embodiments, the sequestering polymer is partly neutralised. The term "partly neutralised" excludes neutralisation of more than 90% of the free acid (ideally carboxy) groups. If the polymer is added as a granulate into the composition then it is preferable for the granulometry to be "small" to improve its dissolution into the largely aqueous volume of the compositions, as well as improng the aesthetics and stability of the hard surface cleaning compositions form therefrom. By small we mean that at least 60% of the particles are 300 microns or less. Typically such polymer granules are prepared by spray drying processes, as opposed to fluid bed drying where larger particle sizes are produced. Preferably the average MW (Mw) of the sequestering polymer polymer should be greater than 1,000, ideally greater than 2,000, based upon the free acid.

By way of non-limiting examples, specific preferred sequestering polymers include those commercially available as Acumer® 5000 (ex. Rohm & Haas) is described to be poly(acrylic acid/2-acrylamido-2-methyl propane sulfonic acid), TX12384 (ex. Nalco), as well as Atlox® 4913, (ex. Uniquema) is described to be a polymethyl methacrylate-polyethylene glycol graft copolymer.

While the sequestering polymer constituent may be present in any effective amount, advantageously it forms 0.01-5% wt., preferably 0.01-2% wt. of the hard surface cleaning composition of which it forms a part.

The inventors have surprisingly observed that hard surface cleaning compositions as taught wherein which necessarily acetic acid as the acid constituent, in conjunction with a nonionic surfactant based on a Guerbet alcohol, further with a sequestering polymer provided excellent hard surface cleaning of stains, especially soaps scum and limescale at a pH of approximately 3. Such is a surprising and beneficial technical advance as prior art compositions typically required a pH of about 0-1 in order to achieve similar results. Thus, preferred embodiments of the invention provide highly effective hard surface cleaning compositions which are effective at higher pH's which makes them also safer to use by consumers.

While not wishing to be bound by the following, it is nonetheless hypothesized by the inventors that the selection of the particularly preferred constituents, namely acetic acid as the acid constituent (and preferably the sole acid present in the acid constituent), a nonionic alkoxylated surfactant based on a Guerbet alcohol, an a sequestering polymer and provided in an aqueous composition at a pH of 2.5-3.5, and especially preferably at a pH of about 3 provide unexpectedly superior results based on possible interactions and/or cooperative benefits of these particularly preferred compositions which are manifest in the treatment of certain stains, particularly in the removal of soap scum (calcium stearate) deposits (stains) and lime scale (calcium carbonate) deposits (stains). In the preferred embodiments of the invention it is believed that the sequestering polymer constituent may operate by either removing calcium from the surface via a complexation mechanism or adsorbing on loosened crystals of limescale; such may render the calcium stearate as less ionic and allowing the nonionic alkoxylated surfactant based on a Guerbet alcohol to associate with the now less ionic stearic acid, which is nonetheless still insoluble in water. It is hypothesized that the said nonionic alkoxylated surfactant (e.g., Ethylan 1008) exhibits an affinity for this complexation and imparts improved aqueous solubility to the complex in water and may aid in its suspension in the inventive compositions which may be wiped away and/or rinsed. Thus this interaction may be responsible to minimize redeposition onto the hard surface being treated. It is also hypothesized that the said nonionic surfactant exhibits good wetting of for the calcium stearates and lime scale and may enhance access and delivery of the other constituents of the inventive compositions into the surface deposits. It is also hypothesized that the sequestering polymer may adsorb on loosened or more porous systems which have been partly dissolved by the acid constituent, especially wherein such is acetic acid. Acetic acid is preferred for use in the acid constituent, as it is believed to be a smaller molecule compared to other organic acids, viz., citric acid, tartaric acid, and may be more likely to enter the porous lime scale easier and/or exhibit improved solubilization of stearate compounds than other acids have. This effect is believed to be synergistic in combination with the sequestering polymer and said nonionic surfactant constituent in enhancing the solubility and re-suspension of the sterate acid/salts, as well as softening the calcium carbonate deposits to allow the sequestering polymer to assist in their removal in the manner hypothesized above.

The inventors have also observed that the preferred embodiments of the invention provide superior cleaning without causing undue deleterious effects on a wide variety of hard surfaces of the types which are frequently encountered in domestic or commercial lavatory and kitchen environments. Such has been observed when preferred compositions of the invention have been applied both in a liquid form, e.g, sprayed or poured onto said hard surfaces, as well as having been applied via a wipe article.

The inventive compositions may optionally include one or more one or more further constituents useful in improving one or more aesthetic characteristics or the compositions or in improving one or more technical characteristics of the compositions. Exemplary further optional constituents include coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents providing improved technical or aesthetic characteristics known to the relevant art. When present, the total amount of such one or more optional constituents present in the inventive compositions do not exceed about 10% wt., preferably do not exceed 2.5% wt., and most preferably do not exceed 1.5% wt.

By way of non-limiting example pH adjusting agents include phosphorus containing compounds, monovalent and polyvalent salts such as of silicates, carbonates, and borates, certain acids and bases, tartrates and certain acetates. Further exemplary pH adjusting agents include mineral acids, basic compositions, and organic acids, which are typically required in only minor amounts. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, and their alkali metal salts. When present, the pH adjusting agent, especially the pH buffers are present in an amount effective in order to maintain the pH of the inventive composition within a target pH range.

The inventive compositions may include one or more coloring agents which may be included to impart a desired color or tint to the compositions.

The compositions of the invention optionally but in certain cases desirably include a fragrance constituent. Fragrance raw materials may be divided into three main groups: (1) the essential oils and products isolated from these oils; (2) products of animal origin; and (3) synthetic chemicals.

The essential oils consist of complex mixtures of volatile liquid and solid chemicals found in various parts of plants. Mention may be made of oils found in flowers, e.g., jasmine, rose, mimosa, and orange blossom; flowers and leaves, e.g., lavender and rosemary; leaves and stems, e.g., geranium, patchouli, and petitgrain; barks, e.g., cinnamon; woods, e.g., sandalwood and rosewood; roots, e.g., angelica; rhizomes, e.g., ginger; fruits, e.g., orange, lemon, and bergamot; seeds, e.g., aniseed and nutmeg; and resinous exudations, e.g., myrrh. These essential oils consist of a complex mixture of chemicals, the major portion thereof being terpenes, including hydrocarbons of the formula $(C_5H_8)_n$ and their oxygenated derivatives. Hydrocarbons such as these give rise to a large number of oxygenated derivatives, e.g., alcohols and their esters, aldehydes and ketones. Some of the more important of these are geraniol, citronellol and terpineol, citral and citronellal, and camphor. Other constituents include aliphatic aldehydes and also aromatic compounds including phenols such as eugenol. In some instances, specific compounds may be isolated from the essential oils, usually by distillation in a commercially pure state, for example, geraniol and citronellal from citronella oil; citral from lemon-grass oil; eugenol from clove oil; linalool from rosewood oil; and safrole from sassafras oil. The natural isolates may also be chemically modified as in the case of citronellal to hydroxy citronellal, citral to ionone, eugenol to vanillin, linalool to linalyl acetate, and safrol to heliotropin.

Animal products used in perfumes include musk, ambergris, civet and castoreum, and are generally provided as alcoholic tinctures.

The synthetic chemicals include not only the synthetically made, also naturally occurring isolates mentioned above, but also include their derivatives and compounds unknown in nature, e.g., isoamylsalicylate, amylcinnamic aldehyde, cyclamen aldehyde, heliotropin, ionone, phenylethyl alcohol, terpineol, undecalactone, and gamma nonyl lactone.

Fragrance compositions as received from a supplier may be provided as an aqueous or organically solvated composition, and may include as a hydrotrope or emulsifier a surface-active agent, typically a surfactant, in minor amount. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

One or more coloring agents may also be used in the inventive compositions in order to impart a desired colored appearance or colored tint to the compositions. Known art water soluble or water dispersible pigments and dyes may be added in effective amounts.

The inventive compositions may include a hydrotrope constituent comprising one or more compounds which exhibit a hydrotropic functionality in the inventive compositions. Exemplary hydrotropes include, inter alia, benzene sulfonates, naphthalene sulfonates, $C_1$-$C_{11}$ alkyl benzene sulfonates, naphthalene sulfonates, $C_5$-$C_{11}$ alkyl sulfonates, $C_6$-$C_{11}$ alkyl sulfates, alkyl diphenyloxide disulfonates, and phosphate ester hydrotropes. The hydrotropic compounds of the invention are often provided in a salt form with a suitable counterion, such as one or more alkali, or alkali earth metals, such as sodium or potassium, especially sodium. However, other water soluble cations such as ammonium, mono-, di- and tri-lower alkyl, i.e., $C_{1-4}$ alkanol ammonium groups can be used in the place of the alkali metal cations. Exemplary alkyl benzene sulfonates include, for example, isopropylbenzene sulfonates, xylene sulfonates, toluene sulfonates, cumene sulfonates, as well as mixtures thereof. Exemplary $C_5$-$C_{11}$ alkyl sulfonates include hexyl sulfonates, octyl sulfonates, and hexyl/octyl sulfonates, and mixtures thereof. Particularly useful hydrotrope compounds include benzene sulfonates, o-toluene sulfonates, m-toluene sulfonates, and p-toluene sulfonates; 2,3-xylene sulfonates, 2,4-xylene sulfonates, and 4,6-xylene sulfonates; cumene sulfonates, wherein such exemplary hydrotropes are generally in a salt form thereof, including sodium and potassium salt forms. When present the hydrotrope constituent may be present in any effective amounts, or they may be omitted. Advantageously, when present, the hydrotrope constituent comprises 0.001-1% wt. of the composition of which it forms a part.

A further optional constituent are one or more preservatives. Such preservatives are primarily included to reduce the growth of undesired microorganisms within the composition during storage prior to use. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. Further exemplary useful preservatives include those which are commercially including a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful and commercially available preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.).

Optionally one or more abrasives may be included in the inventive compositions. Exemplary abrasives include: oxides, e.g., calcined aluminum oxides and the like, carbonates, e.g., calcium carbonate and the like, quartzes, siliceous chalk, diatomaceous earth, colloidal silicon dioxide, alkali metasilicates, e.g., sodium metasilicate and the like, perlite, pumice, feldspar, calcium phosphate, organic abrasive materials based on comminuted or particulate polymers especially one or more of polyolefins, polyethylenes, polypropylenes, polyesters, polystyrenes, acetonitrile-butadiene-styrene resins, melamines, polycarbonates, phenolic resins, epoxies and polyurethanes, natural materials such as, for example, rice hulls, corn cobs, and the like, or talc and mixtures thereof. The particle size of the abrasive agent typically may range from about 1 μm to about 1000 μm, preferably between about 10 μm to about 200 μm, and more preferably between about 10 μm and about 100 μm. It is preferred to us those abrasive agents that will not scratch most hard surfaces. Such abrasive agents include calcium carbonate, siliceous chalk, diatomaceous earth, colloidal silicon dioxide, sodium metasilicate, talc, and organic abrasive materials. Calcium carbonate is preferred as being effective and available at a generally low cost. A single type of abrasive, or a mixture of two or more differing abrasive materials may be used.

Optionally the compositions may include an effective amount of at least one water soluble inorganic salt, which may be present in any amount which is found to provide some technical improvement to the compositions of which they form a part. For purposes of the present invention, "water-soluble" means having a solubility in water of at least 10 grams per hundred grams of water at 20° C. Examples of suitable salts include various alkali metal and/or alkaline earth metal chlorides including sodium chloride, calcium chloride, magnesium chloride and zinc chloride. Particularly preferred are sodium chloride and calcium chloride which have been surprisingly observed to provide excellent metal cleaning efficacy particularly of aged copper surfaces. When present such water soluble inorganic salts may be presend in amounts of from about 0.00001 to about 2.5% by weight, desirably in amounts of 0.001 to about 2% by weight, yet more desirably from about 0.01 to about 1.5% by weight and most desirably from about 0.2 to about 1.5% weight. It is to be noted however, that in certain preferred embodiments such water soluble inorganic salts may deleteriously affect the cleaning performance of certain stains, such as soap scum and rust cleaning as the presence of such water soluble inorganic salts may release ions which would interfere with the ability of oxalic acid and/or formic acid to provide a good cleaning benefit. Thus in certain preferred embodiments, such water soluble inorganic salts are excluded from compositions according to the invention.

As is noted above, the compositions according to the invention are largely aqueous in nature. Water is added to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention. Preferably at least 80% wt, more preferably at least 85% wt of the compositions are water.

According to particularly preferred embodiments, the present invention provides a highly aqueous liquid acidic hard surface cleaning composition having a pH of about 2-4, preferably from about 2.8-3.3 which necessarily comprises (and in certain especially preferred embodiments consists of, or consists essentially of):

0.1-7% wt., preferably 2-5% wt. of an acid constituent comprising acetic acid, and optionally one or more further organic acids, but especially preferably wherein the acid constituent solely consists of acetic acid;

0.5-5% wt., preferably 2-5% wt. of at least one nonionic surfactant, and especially preferably wherein the nonionic surfactants are derived from Guebert alcohols, and particularly preferably wherein the sole nonionic surfactants present are derived from Guebert alcohols;

0.1-7% wt., preferably 0.5-5% wt., of an organic solvent constituent which comprises at least one glycol ether solvent, and which preferably solely consists of only glycol ether solvents to the exclusion of other organic solvents;

0.01-5% wt., preferably 0.01-2% wt. of a sequestering polymer constituent;

0-5% wt. a cosurfactant constituent, including one or more nonionic, cationic, amphoteric or zwitterionic surfactants; but preferably wherein the sole cosurfactant constituents are selected from cationic surfactants;

0-5% wt. of one or more further constituents selected coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents known to the art;

and the balance, water, wherein water comprises at least 85% wt. of the composition.

Whereas the compositions of the present invention are intended to be used in the types of liquid forms described, nothing in this specification shall be understood as to limit the use of the composition according to the invention with a further amount of water to form a cleaning solution therefrom. In such a proposed diluted cleaning solution, the greater the proportion of water added to form said cleaning dilution will, the greater may be the reduction of the rate and/or efficacy of the thus formed cleaning solution. Accordingly, longer residence times upon the stain to effect their loosening and/or the usage of greater amounts may be necessitated. Conversely, nothing in the specification shall be also understood to limit the forming of a "super-concentrated" cleaning composition based upon the composition described above. Such a super-concentrated ingredient composition is essentially the same as the cleaning compositions described above except in that they include a lesser amount of water.

The composition of the present invention, whether as described herein or in a concentrate or super concentrate form, can also be applied to a hard surface by the use of a carrier substrate. One example of a useful carrier substrate is a wet wipe. The wipe can be of a woven or non-woven nature. Fabric substrates can include nonwoven or woven pouches, sponges including both closed cell and open celled sponges, including sponges formed from celluloses as well as other polymeric material, as well as in the form of abrasive or non-abrasive cleaning pads. Such fabrics are known commercially in this field and are often referred to as wipes. Such substrates can be resin bonded, hydroentangled, thermally bonded, meltblown, needlepunched, or any combination of the former. The carrier substrate useful with the present inventive compositions may also be a wipe which includes a film forming substrate such as a water soluble polymer. Such self-supporting film substrates may be sandwiched between layers of fabric substrates and heat sealed to form a useful substrate.

The compositions of the present invention are advantageously absorbed onto the carrier substrate, i.e., a wipe to form a saturated wipe. The wipe can then be sealed individually in a pouch which can then be opened when needed or a multitude of wipes can be placed in a container for use on an as needed basis. The container, when closed, sufficiently sealed to prevent evaporation of any components from the compositions. In use, a wipe is removed from the container and then wiped across an area in need of treatment; in case of difficult to treat stains the wipe may be re-wiped across the area in need of treatment, or a plurality of saturated wipes may also be used.

Such a hard surface cleaning compositions according to the invention may be may be directly applied to a hard surface. By way of example, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone. Such hard surfaces described above are to be understood as being recited by way of illustration and not be way of limitation.

Certain embodiments of the invention, including certain particularly preferred embodiments of the invention are disclosed in the following examples.

EXAMPLES

A number of formulations were produced by mixing the constituents outlined in Table 1 by adding the individual constituents into a beaker of deionized water at room temperature which was stirred with a conventional magnetic stirring rod. Stirring continued until the formulation was homogenous in appearance. It is to be noted that the constituents might be added in any order, but it is preferred that a first premixture is made of any fragrance constituent with one or more surfactants used in the inventive compositions. Thereafter, a major amount of water is first provided to a suitable mixing vessel or apparatus as it is the major constituent and thereafter the further constituents are added thereto convenient. The order of addition is not critical, but good results are obtained where the surfactants (which may be also the premixture of the fragrance and surfactants) are added to the water prior to the remaining constituents.

The exact compositions of the example formulations are listed on Table 1, below, and are identified by one or more digits preceded by the letter "E". Certain comparative compositions are also disclosed on Table 1, and are identified by one or more digits preceded by the letter "C".

TABLE 1

| | E1 | E2 | E3 | E4 | E5 | E6 | E7 | — | E9 | E10 |
|---|---|---|---|---|---|---|---|---|---|---|
| Dowanol ® PnP | 0.3 | 0.3 | 0.3 | 0.3 | 0.3 | 0.3 | 0.3 | — | 0.3 | 0.3 |
| acetic acid | 2.0 | 1.0 | 1.0 | 2.1 | 1.5 | 0.8 | 0.8 | — | 1.5 | 3.5 |
| Ethylan ® 1008 | — | — | — | — | — | — | — | — | — | 4.0 |
| AG6210 | 4.0 | 3.0 | 3.0 | 3.0 | 3.0 | 2.0 | 2.0 | — | 2.0 | — |
| Acumer ® 5000 | 0.5 | 0.5 | — | — | — | 0.5 | — | — | — | — |
| Atlox ® 4913 | — | — | 0.5 | — | — | — | 0.5 | — | — | — |
| TX12384 | — | — | — | 0.5 | 0.5 | — | — | — | 0.5 | 0.5 |

TABLE 1-continued

| | | | | | | | | | | |
|---|---|---|---|---|---|---|---|---|---|---|
| fragrance | 0.15 | 0.15 | 0.15 | 0.15 | 0.15 | 0.15 | 0.15 | — | 0.15 | 0.15 |
| colorant | 0.0005 | 0.0005 | 0.0005 | 0.0005 | 0.0005 | 0.0005 | 0.0005 | — | 0.0005 | 0.0005 |
| DI water | q.s. | q.s. | q.s. | q.s. | q.s. | q.s. | q.s. | — | q.s. | q.s. |
| pH | 3 | 3 | 3 | 3 | 3 | 3 | 3 | — | 3 | 3 |

| | E11 | E12 | — | E14 | E15 | E16 | — | E18 | E19 | E20 | — |
|---|---|---|---|---|---|---|---|---|---|---|---|
| Dowanol ® PnP | 0.3 | 0.3 | — | 0.3 | 0.3 | 0.3 | — | 0.3 | 0.3 | 0.3 | — |
| acetic acid | 2.0 | 2.0 | — | 3.0 | 1.7 | 1.5 | — | 3.5 | 1.2 | 1.5 | — |
| Ethylan ® 1008 | 4.0 | 4.0 | — | 3.0 | 3.0 | 3.0 | — | 2.0 | 2.0 | 2.0 | — |
| AG6210 | — | — | — | — | — | — | — | — | — | — | — |
| Acumer ® 5000 | 0.5 | — | — | — | 0.5 | — | — | — | 0.5 | — | — |
| Atlox ® 4913 | — | 0.5 | — | — | — | 0.5 | — | — | — | 0.5 | — |
| TX12384 | — | — | — | 0.5 | — | — | — | 0.5 | — | — | — |
| fragrance | 0.15 | 0.15 | — | 0.15 | 0.15 | 0.15 | — | 0.15 | 0.15 | 0.15 | — |
| colorant | 0.0005 | 0.0005 | — | 0.0005 | 0.0005 | 0.0005 | — | 0.0005 | 0.0005 | 0.0005 | — |
| DI water | q.s. | q.s. | — | q.s. | q.s. | q.s. | — | q.s. | q.s. | q.s. | — |
| pH | 3 | 3 | — | 3 | 3 | 3 | — | 3 | 3 | 3 | — |

| | E22 | — | E24 | E25 | E26 |
|---|---|---|---|---|---|
| Dowanol ® PnP | 0.3 | — | 0.3 | 0.3 | 0.3 |
| acetic acid | 2.0 | — | 2.0 | 3.5 | 2.0 |
| Ethylan ® 1008 | 4.0 | — | 4.0 | 4.0 | — |
| AG6210 | — | — | — | — | 4.0 |
| Acumer ® 5000 | 0.5 | — | — | — | 0.5 |
| Atlox ® 4913 | — | — | 0.5 | — | — |
| TX12384 | — | — | — | 0.5 | — |
| DI water | q.s. | — | q.s. | q.s. | q.s. |
| pH | 3 | — | 3 | 3 | 3 |

| | E27 | E28 | — | E30 | E31 | E32 | — | E34 | E35 | E36 | — | E38 |
|---|---|---|---|---|---|---|---|---|---|---|---|---|
| Dowanol ® PnP | 0.3 | 0.3 | — | 0.3 | 0.3 | 0.3 | — | 0.3 | 0.3 | 0.3 | — | 0.3 |
| acetic acid | 3-5* | 3-5* | — | 3-5* | 3-5* | 3-5* | — | 3-5* | 3-4** | 3-4** | — | 3-4** |
| Ethylan ® 1008 | — | — | — | — | 4 | 4 | — | 4 | — | — | — | — |
| AG6210 | 4 | 4 | — | 4 | — | — | — | — | — | — | — | — |
| amine oxide | — | — | — | — | — | — | — | — | 4 | 4 | — | 4 |
| Acumer ® 5000 | 0.5 | — | — | — | 0.5 | — | — | — | 0.5 | — | — | — |
| Atlox ® 4913 | — | 0.5 | — | — | — | 0.5 | — | — | — | 0.5 | — | — |
| TX12384 | — | — | — | 0.5 | — | — | — | 0.5 | — | — | — | 0.5 |
| fragrance | 0.15 | 0.15 | — | 0.15 | 0.15 | 0.15 | — | 0.15 | 0.15 | 0.15 | — | 0.15 |
| colorant | 0.0005 | 0.0005 | — | 0.0005 | 0.0005 | 0.0005 | — | 0.0005 | 0.0005 | 0.0005 | — | 0.0005 |
| DI water | q.s. | q.s. | — | q.s. | q.s. | q.s. | — | q.s. | q.s. | q.s. | — | q.s. |
| pH | 3 | 3 | — | 3 | 3 | 3 | — | 3 | 3 | 3 | — | 3 |

*3-5% wt. glacial acetic acid was added in q.s. to provide a pH = 3 for these compositions
**3-4% wt. glacial acetic acid was added in q.s. to provide a pH = 3 for these compositions All of the formulations on the foregoing Table 1 are indicated in weight percent, and each composition comprised 100% wt. The individual constituents were used, "as-supplied" from their respective source and unless otherwise indicated, each of the constituents are to be understood as being "100% wt. actives". Deionized water was added in quantum sufficient, "q.s.", to provide the balance to 100% wt. of each of the example compositions. The sources of the constituents used in the formulations of Tables 1 are described on the following Table 2.

TABLE 2

| | |
|---|---|
| Dowanol ® PnP | 1-propoxypropanol-2 (99.5% actives) (ex. Dow Chemical Co.) |
| acetic acid | glacial acetic acid (99-100% wt. actives) |
| Ethylan ® 1008 | C10-Guerbet-alcohol derivative nonionic surfactant (100% wt. actives) (ex. AkzoNobel) |
| AG6210 | Guerbet-alcohol-derivative-alkylpolyglycoside nonionic surfactant (100% wt. actives) (ex. AkzoNobel) |
| amine oxide | alkyl dimethyl amine oxide (50-100% wt. actives) (ex. McIntyre Group Ltd.) |
| Acumer ® 5000 | poly(acrylic acid/2-acrylamido-2-methyl propane sulfonic acid) (100% wt. actives) (ex. Rohm & Haas) |
| Atlox ® 4913 | polymethyl methacrylate-polyethylene glycol graft copolymer (100% wt. actives) (ex. Uniquema) |
| TX12384 | polysulfonic acid polymer (ex. Nalco) |
| fragrance | proprietary composition of its supplier |
| colorant | proprietary composition of its supplier |
| DI water | deionized water |

Limescale Removal Efficacy (Glass Substrate):

The efficacy of the compositions in the dissolution of limescale removal from glass substrates was demonstrated by the following test.

A series of clean transparent glass microscope slides were prepared by first cleaning and drying the same. Afterwards, the slides were sprayed with a pressurized airgun containing a standardized water sample containing 172 ppm calcium in order to coat the surfaces of each of the slides, which were thereafter dried for at least 4 hours in a laboratory oven, thereafter the slides were removed and allowed to cool on a laboratory benchtop, and thereafter the treatment process of spraying, drying, and cooling were repeated until a uniform layer of limescale was encrusted on each of the microscope slides. Each of the slides were treated an equal number of times in order to ensure homogeneity in the thickness of the limescale encrustation. It was observed that the encrusted limescale was hard, and could not be easily removed without scraping.

Thereafter equal numbers of replicate samples of limescale encrusted slides were partially immersed in beakers containing each of the example compositions disclosed on Table 3, and after 1 minute, each of the slides were removed and washed on both front and back surfaces with deionized water for 10 seconds, and thereafter were placed in a vertical rack and allowed to dry.

Subsequently when all of the tiles were fully dry, a group of 16 panelists were asked to visually observe and evaluate the limescale removal efficacy on a scale of "0" to "10", the former being represented by a prepared but untreated limescale encrusted laboratory slide randomly selected from the previously prepared microscope slides later treated by the test compositions, the latter being represented by a clean glass microscope slide. The scaled evaluations were relative to these two representative samples which were used by the panelists as reference values for "0" and "10". The averaged results of observed limescale removal efficacy are reported on the following Table 3.

TABLE 3

| Limescale Removal Efficacy | |
|---|---|
| | rating |
| E27 | 7.89 |
| E28 | 8.72 |
| E30 | 8.84 |
| E31 | 9.48 |
| E32 | 8.94 |
| E34 | 8.58 |
| E35 | 6.58 |
| E36 | 9.04 |
| E38 | 6.38 |

As evident from the reported results, good limescale removal was observed.

Limescale Dissolution Evaluation:

The efficacy of the compositions in the dissolution of limescale was demonstrated by the following test.

Several pre-weighed and dried marble cubes (measured in grams) were first prepared by rinsing them with copious amounts of deionized water and subsequently the rinsed marble cubes were placed into a 105° C. oven for at least one hour in order to fully dry. The marble cubes were then removed from the oven, and allowed to cool to room temperature (approx. 20° C.) and each was then individually weighed on an analytical balance. Thereafter, for each tested formulation tested, two marble cube was placed into separate a trays, and 8 ml of a test composition was placed on top of the cube and allowed to remain there for 5 minutes for the first cube, and 10 minutes for the second cube, after which the cubes were then individually rinsed with copious amounts of deionized water and again, after rinsing, each of the cubes was placed into a 105° C. oven for at least one hour in order to fully dry. Subsequently the cubes were allowed to cool to room temperature and reweighed.

The percentage loss of each of the cubes was calculated, and the results are indicated on the following table.

TABLE 4

| Limescale Dissolution Efficacy | |
|---|---|
| | % wt. limescale removed |
| E34 | 0.05 |

As is evident from the foregoing results, the tested compositions provided a good degree of dissolution of the marble cubes tested.

Soap Scum Cleaning Evaluation:

The efficacy of the example compositions according to the invention as well as that of the commercially available products in removing soap scum from a hard surface was evaluated. The test protocol used was that established by the German Cosmetic, Toiletry, Perfumery and Detergent Association (IKW, viz., the "Industrieverband Korperpflege- und Waschmittel e.V.") and published as "Recommendations for the Quality Assessment of Bathroom Cleaners" (version 2002), published in the SÖFW-Journal, 129, November, 2003. The specific test of the published tests used based on that under "3.2 Determination of the cleaner's ability to remove lime soaps", which was generally adhered to as indicated in the following.

For this test high-gloss white ceramic tiles (4 inch by 4 inch glazed glossy white ceramic bathroom tiles), were initially cleaned with a mild abrasive cleaner, rinsed with water and wiped with ethanol. Subsequently the tiles are dried for 1 hour at 180° C. in a preheated drying cabinet and then weighed.

The test soil used was a calcium stearate suspension of the following composition:

85.0% ethanol, 96 MEK (denatured)
5.0% calcium stearate, fine
9.8% water, demineralized
0.2% soot/special black 4

Ethanol was made ready and calcium stearate was stirred into it. Then water and soot were added. The suspension was placed in an ultrasonic bath for 10 minutes and subsequently homogenized over 3 minutes with a Turrax (approx. 5000/min).

The suspension was applied onto the tiles from a distance of approximately. 25 cm with an airbrush pistol, (e.g. Badger model 150 with jet L). As a consequence of adjusting the airbrush system some of the ethanol was blown out by the compressed air (recommended pressure 2 bar), therefore the quantity to be applied was determined in pretests.

The tiles were dried for 1 hour at room temperature and then stored for 1 hour in a horizontal position in a preheated circulating drying oven at 180° C. in order to melt the calcium stearate. Cooling was allowed to take place for approx. 1 hour in the switched off and slightly opened drying oven. The effectively applied mass of calcium stearate was calculated by another weighing and by determining the difference in weight compared with the empty, dried tile. According to the mass of the 5% calcium stearate suspension was applied (=5 g), in the test only tiles are used onto which 0.25 g±0.02 g of calcium stearate had been melted. Before testing the tiles were stored for at least 24 hours at room temperature.

Testing was carried out in the form of a six fold determination. For this purpose 0.5 ml of undiluted cleaner was placed with a pipette on an area of 3×2 cm on the tile for one of several contact times. Each of the tested compositions were evaluated by using six tile replicates for each contact time tested. The contact times were 2.5 minutes, 5 minutes, 7 minutes and 10 minutes. Subsequently each tile was rinsed under running water, and the loosened calcium stearate was removed mechanically by wiping a moist, fine-pored viscose sponge (approx. 90×40×40 mm) once across the surface of the tile without applying any pressure Then each tile was rinsed with fully demineralized water and dried at room temperature.

After drying the cleaning performance of each test tile and composition was visually assessed by three trained observers for each test tile, who estimated the soil removal in percent. To reduce variations of assessments, the observers were trained using suitable evaluation samples; the ratings established by the observers were relative to a sample soiled tile which was used as a "0%" removal reference, and a clean unsoiled tile which was used as a "100%" removal reference. The cleaning performance for each of the tested compositions was arrived at from the mean value of the reported soil removal for each tested composition as reported by the three trained observers. The results are reported on the following table.

TABLE 5

| Soapscum Removal Efficacy | |
|---|---|
| | % removal |
| E27 | 90 |
| E28 | 80 |
| E30 | 70 |
| E31 | 98 |
| E32 | 95 |
| E34 | 95 |
| E35 | 80 |
| E36 | 50-60 |
| E38 | 70-80 |

As can be seen from the foregoing results, the compositions provided excellent soapscum removal from the test substrates.

Cleaning of Organic Soil (Greasy Wallboard):

Cleaning evaluations were performed in accordance with the testing protocol outlined according to ASTM D4488 A2 Test Method, which evaluated the efficacy of the cleaning compositions in removing a standardized greasy organic soil on masonite wallboard samples painted with white wall paint. The soil applied was a standardized greasy soil containing:

| Test Greasy Soil | % w/w |
|---|---|
| vegetable oil | 33 |
| vegetable shortening | 33 |
| lard | 33 |
| carbon black | 1 |

which were blended together to homogeneity under gentle heating to form a uniform mixture which was later allowed to cool to room temperature. The sponge (water dampened) of a Gardner Abrasion Tester apparatus was squirted with a 15 gram sample of a tested cleaning composition, and the apparatus was cycled 2 times. The test was replicated 4 times for each tested composition. The tiles were dried, and then the cleaning efficacy was evaluated.

The percentage of the test greasy soil removal from each tile was determined by a group of panelists who visually evaluated the degree of removal on a scale of "0" to "10" wherein a "0" was based on a soiled but untreated wallboard tile, and wherein a "10" was based on an unsoiled wallboard tile. The results of this evaluation was averaged for each of the tested compositions, and the results of the evaluation are reported on the following table.

TABLE 6

| Greasy Wallboard | |
|---|---|
| | rating |
| E10 | 6.17 |
| E11 | 5.66 |
| E12 | 6.45 |

As can be seen from the results of the forgoing Table 6, the compositions according to the invention provided good cleaning of the greasy wallboard substrates.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

The invention claimed is:

1. An aqueous liquid acidic hard surface cleaning composition having a pH of about 2-4, which necessarily comprises:

0.1-7% wt., of an organic acid constituent which consists solely of acetic acid;

0.5-5% wt., of at least one nonionic surfactant derived from Guerbet alcohols;

0.1-7% wt., of an organic solvent constituent which comprises at least one glycol ether solvent;

0.01-5% wt., of a sequestering polymer constituent selected from the group consisting of polymethyl methacrylate-polyethylene glycol graft copolymers, and poly (acrylic acid/2-acrylamido-2-methyl propane sulfonic acid);

0-5% wt. of a cosurfactant constituent selected from the group consisting of nonionic, cationic, amphoteric, zwitterionic surfactants, and mixtures thereof;

0-5% wt. of one or more constituents selected from the group consisting of coloring agents, fragrances and fragrance solubilizers, viscosity modifying agents thickeners, pH adjusting agents and pH buffers, optical brighteners, opacifying agents, hydrotropes, abrasives, and preservatives;

and the balance, water, wherein water comprises at least 80% wt. of the composition and the acetic acid is the sole acid present in the composition.

2. A method of treating soap scum or limescale stains on a hard surface, said method comprising the step of: applying a cleaning effective amount of a highly aqueous liquid acidic hard surface cleaning composition according to claim 1.

3. An aqueous liquid acidic hard surface cleaning composition according to claim 1, having a pH of from about 2.8-3.3 which comprises:

2-5% wt. of an organic acid constituent which consists solely of acetic acid, ;

2-5% wt. of at least one nonionic surfactant derived from Guebert alcohols;

0.5-5% wt., of an organic solvent constituent which comprises at least one glycol ether solvent;

0.01-2% wt. of a sequestering polymer constituent selected from the group consisting of polymethyl methacrylate-polyethylene glycol graft copolymers, and poly(acrylic acid/2-acrylamido-2-methyl propane sulfonic acid);

0-5% wt. of a cosurfactant constituent selected from the group consisting of nonionic, cationic, amphoteric, zwitterionic surfactants, and mixtures thereof;

0-5% wt. of one or more constituents selected from the group consisting of coloring agents, fragrances and fragrance solubilizers, viscosity modifying agents thickeners, pH adjusting agents and pH buffers, optical brighteners, opacifying agents, hydrotropes, abrasives, and preservatives;

and the balance, water, wherein water comprises at least 85% wt. of the composition and the acetic acid is the sole acid present in the composition.

4. The hard surface cleaning composition according to claim 3, wherein the nonionic surfactant based on Guerbet alcohols is the sole surfactant constituent present in the compositions, to the exclusion of further nonionic, cationic, amphoteric or zwitterionic surfactants.

5. The hard surface cleaning composition according to claim 3 wherein the organic solvent constituent consists of only glycol ether solvents to the exclusion of other organic solvents.

6. The hard surface cleaning composition according to claim 3 wherein one or more cationic surfactants are present as the sole cosurfactant constituents present in the composition.

7. A wipe article comprising the cleaning composition according to claim 3.

8. A wipe article comprising the cleaning composition according to claim 1.

* * * * *